US008215513B1

(12) United States Patent
Grissom

(10) Patent No.: US 8,215,513 B1
(45) Date of Patent: Jul. 10, 2012

(54) SELF-CLOSING RESEALABLE CAN END

(75) Inventor: Michael D. Grissom, Morrisville, NC (US)

(73) Assignee: Popseal LLC., Chapel Hill, NC (US)

( * ) Notice: Subject to any disclaimer, the term of this patent is extended or adjusted under 35 U.S.C. 154(b) by 698 days.

(21) Appl. No.: 12/195,372

(22) Filed: Aug. 20, 2008

Related U.S. Application Data

(60) Provisional application No. 60/965,363, filed on Aug. 20, 2007.

(51) Int. Cl.
*B65D 17/32* (2006.01)
*B65D 41/32* (2006.01)
*B65D 51/18* (2006.01)

(52) U.S. Cl. ..... 220/268; 220/254.3; 220/266; 220/906

(58) Field of Classification Search ..... 220/268, 220/266, 265, 906, 719, 254.3, 257.1, 281; 215/305, 295; 7/151; 81/3.33, 3.15, 3.37, 81/3.42
See application file for complete search history.

(56) References Cited

U.S. PATENT DOCUMENTS 3,250,425 A 5/1966 Stec
3,334,795 A 8/1967 Cochrell
3,428,212 A 2/1969 Rohrlick
3,794,206 A 2/1974 De Line
3,804,287 A 4/1974 Balocca
3,807,597 A 4/1974 Wells
3,843,011 A * 10/1974 Perry ..... 220/260
3,860,143 A 1/1975 Strobe
3,880,316 A 4/1975 Martella
3,881,437 A 5/1975 Lovell
3,881,630 A 5/1975 Lovell
3,883,034 A 5/1975 Rausing
3,902,626 A 9/1975 Jordan
3,904,071 A 9/1975 Stearns
3,913,779 A 10/1975 Blazer
3,935,961 A 2/1976 Bennett
3,951,298 A 4/1976 Klein
3,952,911 A 4/1976 Bozek
3,952,914 A 4/1976 Vogt
3,967,749 A 7/1976 Walter
3,977,561 A 8/1976 Strobe
3,990,603 A 11/1976 Brochman
3,998,354 A 12/1976 Song
4,008,823 A 2/1977 Tarro
4,039,101 A 8/1977 Wells
4,054,228 A 10/1977 Balcocca
4,057,167 A 11/1977 Lee
(Continued)

OTHER PUBLICATIONS

Lepera, Frank, The Evolution of the Easy Open End—Cannex/Asia 2006, Apr. 6, 2006, 65 slides, Sonoco Phoenix.

*Primary Examiner* — Robin Hylton
(74) *Attorney, Agent, or Firm* — Geeta Kadambi; Riddhi IP LLC

(57) ABSTRACT

A self-closing resealable can end for a beverage container that opens the top of the beverage container through downward pressure that causes a gate to move downward relative to the top panel. The gate is retained by a resilient member and when the downward pressure ceases, the gate is moved into proximity with the top panel. Pressure from the carbonation presses the gate against a lip and the gate bends to form an enhanced seal. Other variations are disclosed.

9 Claims, 6 Drawing Sheets

U.S. PATENT DOCUMENTS 4,077,538 A 3/1978 Waterbury
4,083,471 A 4/1978 Frank
4,105,134 A 8/1978 Debenham
4,108,330 A 8/1978 Patterson
4,116,361 A 9/1978 Stargell
4,122,970 A 10/1978 Amabili
4,125,204 A 11/1978 Klein
4,127,212 A 11/1978 Waterbury
4,127,213 A 11/1978 McConnellogue
4,135,637 A 1/1979 Hannula
4,155,480 A 5/1979 Debenham
4,162,742 A 7/1979 Vogt
4,163,506 A 8/1979 Patterson
4,164,303 A 8/1979 Waterbury
4,165,015 A 8/1979 Hasegawa
4,170,724 A 10/1979 Waterbury
4,189,060 A 2/1980 Trotman
4,190,174 A 2/1980 Haimowitz
4,207,991 A 6/1980 Amabili
4,210,257 A 7/1980 Radtke
4,215,792 A 8/1980 Klein
4,232,797 A 11/1980 Waterbury
4,234,099 A 11/1980 Tarro
4,244,315 A 1/1981 Klein
4,244,489 A 1/1981 Klein
4,258,859 A 3/1981 Westphal
4,280,634 A 7/1981 Wiesenberger
4,325,490 A 4/1982 Conrad
4,339,053 A 7/1982 Tarro
4,355,935 A 10/1982 Klein
4,356,929 A 11/1982 Muller-Kuhn
4,377,244 A 3/1983 Rossetti
4,378,074 A 3/1983 Brochman
4,387,826 A 6/1983 Heubl
4,391,385 A 7/1983 Rausing
4,407,424 A 10/1983 Heyn
4,433,792 A 2/1984 Mandrel
4,442,950 A 4/1984 Wilson
4,463,866 A 8/1984 Mandrel
4,465,203 A 8/1984 Lambert
4,493,431 A 1/1985 Cho
4,511,057 A 4/1985 Tontarelli
4,605,141 A 8/1986 Won
4,609,123 A 9/1986 Poncy
4,673,099 A 6/1987 Wells
4,681,238 A 7/1987 Sanchez
4,705,186 A 11/1987 Barrash
4,783,985 A 11/1988 LaBarge
4,784,283 A * 11/1988 Cantu ..... 220/269
RE32,927 E 5/1989 Taylor
4,842,159 A 6/1989 Heidrich
4,928,844 A 5/1990 LaBarge
4,930,654 A 6/1990 Thibeault
4,930,655 A 6/1990 Wells
4,951,835 A 8/1990 DeMars
4,979,635 A 12/1990 Levine
4,982,862 A 1/1991 La Barge
5,035,343 A 7/1991 Morton
5,121,851 A 6/1992 Lyon
5,148,935 A 9/1992 Lyon
5,165,636 A 11/1992 Grissom
5,199,591 A 4/1993 Thibeault
5,232,113 A 8/1993 Chen-Tsai
5,242,073 A 9/1993 Willis
5,248,053 A 9/1993 Lundgren
5,285,924 A 2/1994 Morris
5,346,087 A 9/1994 Klein
5,351,853 A 10/1994 Shock
5,353,942 A 10/1994 Dominguez
5,555,993 A 9/1996 Borkowski
5,680,952 A 10/1997 Chasteen
5,692,633 A * 12/1997 Gordon ..... 220/253
5,706,972 A 1/1998 Sousa
5,711,448 A 1/1998 Clarke, III
5,765,709 A 6/1998 Scott
5,785,199 A 7/1998 Woidtke
5,810,189 A * 9/1998 Baker ..... 220/257.2
5,813,559 A 9/1998 Cho
5,842,594 A 12/1998 Ibara
D403,964 S 1/1999 Jansen
5,975,327 A 11/1999 Funk
6,032,816 A 3/2000 Martin
6,062,414 A 5/2000 Mongarli
6,098,830 A 8/2000 Jamieson
6,129,947 A 10/2000 Grissom
6,206,222 B1 3/2001 Cudzik
6,220,470 B1 4/2001 McHenry
6,244,455 B1 * 6/2001 Lastik ..... 220/254.3
6,286,703 B1 9/2001 Munro
6,290,084 B1 9/2001 Louie
6,347,720 B1 2/2002 Schley
6,427,861 B1 8/2002 Cho
6,460,719 B1 10/2002 Finmark
6,478,179 B1 11/2002 Alexander
6,626,314 B1 9/2003 McHenry
6,722,518 B1 4/2004 Bartz
6,763,963 B1 7/2004 Martin
6,902,078 B2 6/2005 Fiorentini
7,013,757 B2 3/2006 Saviano
7,025,224 B2 4/2006 Coleman
7,089,825 B2 8/2006 Klosterman
7,152,753 B2 12/2006 Huffman

* cited by examiner

SELF-CLOSING RESEALABLE CAN END

RELATED APPLICATIONS

This application claims the benefit of U.S. Provisional Patent Application Ser. No. 60/965,363, filed Aug. 20, 2007, titled "Article of manufacture for a self-closing vented self-resealing beverage can-end."

FIELD OF INVENTION

This invention relates generally to the field of beverage containers, and more particularly to an article of manufacture for an easy-open, self-closing vented, user lip actuated, conical gate opening in a carbonated beverage can-end which automatically sequences to gas-tight self-resealing mode upon carbonated content agitation.

Where the words "upwardly," "downwardly," "inwardly," "outwardly," "under," "underside," "and like words of orientation are used in this application, unless specifically indicated to the contrary, they are to be applied with reference to a can or other container standing on its base in an upright position having a can-end incorporating this invention attached to the top end thereof.

BACKGROUND

When cans became popular for containing beverages openers were needed; subsequently opening tabs were provided in the can-ends and the removable ring-pull tab became very popular. The ring-pull tab evolved into the non-removable stay-tab and hinged non-removable push-down gates to solve the problems of ring-pull tab litter and exposed sharp can opening edges. Exemplary of hinged push-down gates is the triple-fold gate disclosed in U.S. Pat. No. 3,334,795 and U.S. Pat. No. 4,215,792. The basic purpose of these two patents was to provide a one-piece easy-open hinged can top without the need for opening attachments like tabs, levers, and cams. Other types of gated can-ends are also available and the general basic construction of any gated can-end is to provide a gate which is slightly larger than and underlies an opening or aperture in the can-end. The gate, hinged to the can-end at an edge portion of the opening, remains attached to the end when pushed downward into the can to open it.

Prior technology can-ends do not address the problems with spilling, contamination, and gas charge preservation in an economically manufacturable and/or practicable design. Either too much energy and time is needed to form the material, too much material is required to manufacture the can-end, or the can-end design interferes with efficient recyclables, standard packaging, vending machine dimensions, and stackability; or requires the user to hand-operate a device to reseal and reopen the can opening between each sip, if immanently in danger of being contaminated by insects, sand, rain, soap, or other contaminants. The current flip-top is also difficult to open without breaking long fingernails and difficult for young children to open.

SUMMARY

The present invention provides a push-down, easy-open, self-closing, vented, user-lip operated conical gate, self-resealing gas-tight by carbonated content agitation, beverage can-end comprising, a top wall with an integral 360-degree downwardly and inwardly formed dual-fold seam (referred to as "triple-fold" in other patents) which defines the periphery of said conical gate opening, whereabout a 360-degree weakened line underneath thereon defines the circumferential portion of said conical gate, which, when said conical gate is pushed downwardly into the interior of the can, curls upwardly to form a rough severed circumferential edge of said conical gate, whose flange gets bent to a predisposed angle, that when returned to the smooth surface of said dual-fold seam forms a 360-degree gas vent between the mating areas of said rough circumferential edge of said conical gate and smooth surface of said dual-fold seam, with said conical gate attached to said can-end by a separate elastomeric component through a plurality of known fastening means, which together maintain alignment, and return said conical gate to said dual-fold seam into a self-closed, vented position within the opening of said dual-fold seam, and while in said self-closed vented position, the conical gate can be sequenced to a self-resealable gas-tight function by carbonated content agitation, which creates excessive gas flow that exceeds the gas flow limit of said self-closed venting, which causes increased internal pressure that forces the conical gate upwards against said dual-fold seam, causing said gate to circumferentially rotate upwardly and thus compress the inside circumference of the dual-fold seam against the shape-mated outside circumferential area of the conical gate creating a gas-tight seal.

Included herein is an example drawing of a thumb operated non-concentric lever-cam designed not to interfere with stacking, packaging, vending, or recycling. The advantage of the lever-cam over the pull-up stay-tab as used with this invention is that a 180-degree rotation of the lever-cam will fully open the aperture and hold it open which is suitable for conventional drinking or pouring. Rotating 180-degrees back to the original unopened position will allow the conical drink dome to automatically return to a gas venting anti-spill liquid sealed human lip operated gate configuration.

The artistic arrow symbol upwardly embossed into the top of the can end not only clues the first time consumer on which way to rotate the tab but the raised inside edge of the arrow provides one side of a detent that helps prevent the lever from being accidentally rotated and provides along the length of the arrow a ramp for the end of the lever-cam to leverage, against which should reduce the amount of material needed to manufacture the lever. The said lever-cam as used with a ramp is prior art U.S. Pat. No. 5,248,053 issued in 1993.

BRIEF DESCRIPTION OF THE DRAWING FIGURES

Figure 4:
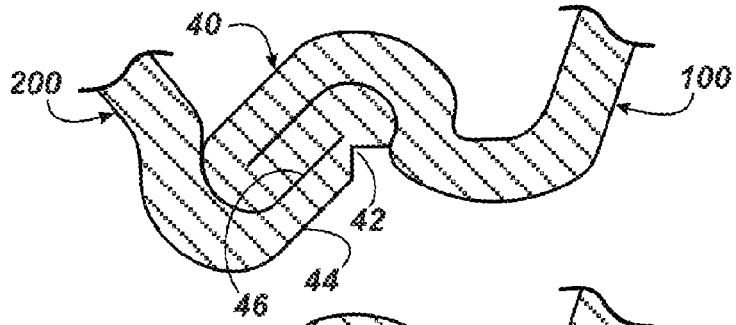
FIG. 4 is a cross-sectional left side close-up view of the triple-fold seal before the score line is broken.
Figure 4A:
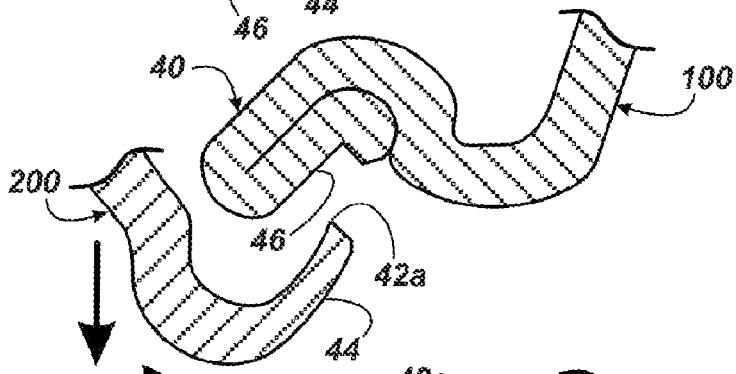

FIG. 4*a* is a cross-sectional left side close-up view of the triple-fold seal with separated score line and resultant curled up flange of the conical drink dome.

Figure 4B:
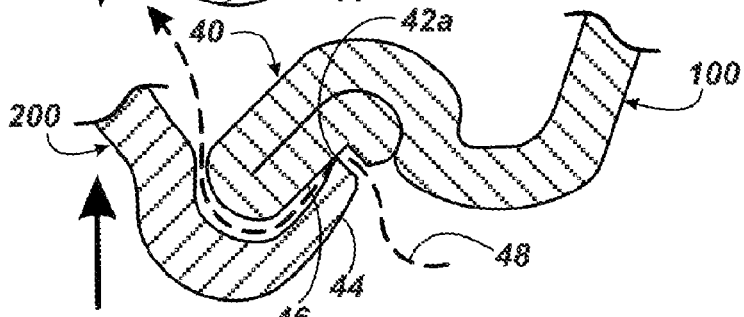

FIG. 4*b* is a cross-sectional left side close-up view of the triple-fold seal with curved up separated score line reseated to create the limited gas vent.

Figure 4C:
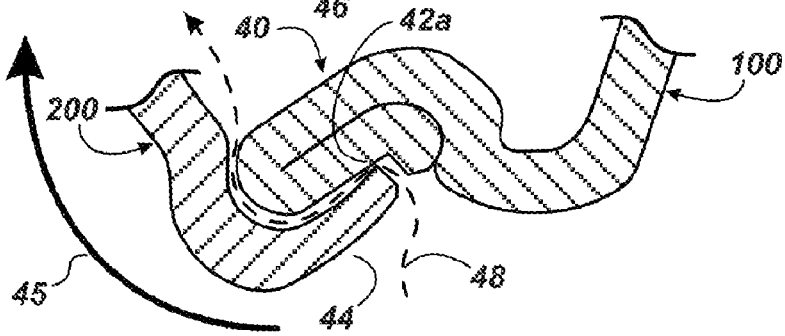

FIG. 4*c* is a cross-sectional left side close-up view of the triple-fold seal responding to abnormal internal pressure and half way though transitioning to gas tight mode.

Figure 4D:
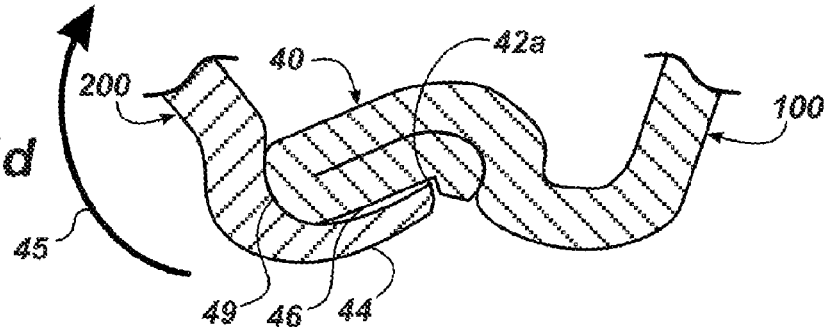

FIG. 4*d* is a cross-sectional left side close-up view of the triple-fold seal fully transitioned into gas tight mode.

Figure 5:
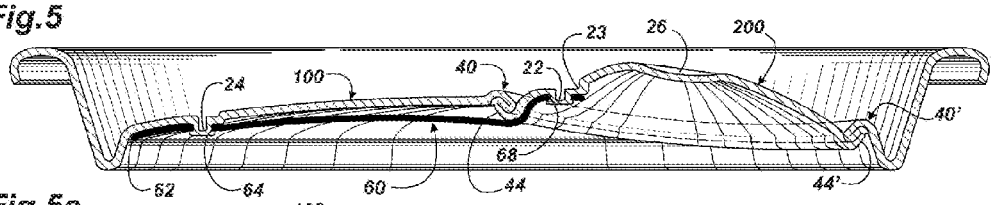

FIG. 5 is a cross-sectional left side view showing the spring and seal before the score line is severed.

Figure 5A:
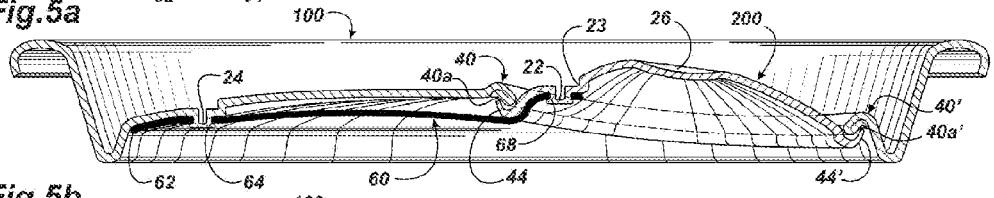

FIG. 5*a* is a cross-sectional left side view showing the spring and seal after the score line is severed, curled up, and reseated to form a gas vent.

Figure 5B:
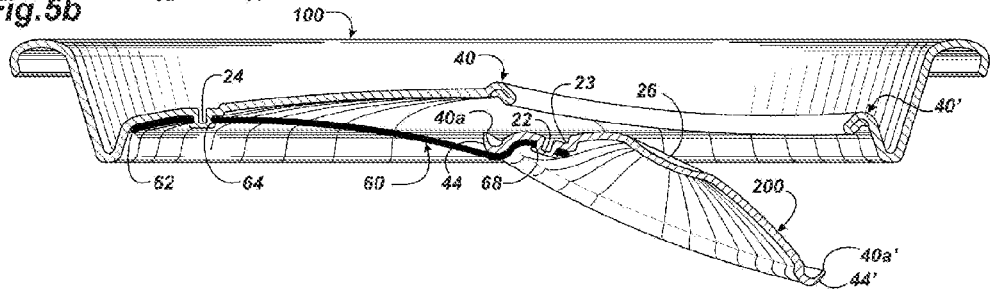

FIG. 5*b* is a cross-sectional left side view showing the spring and conical drink dome in the open position.

Figure 6:
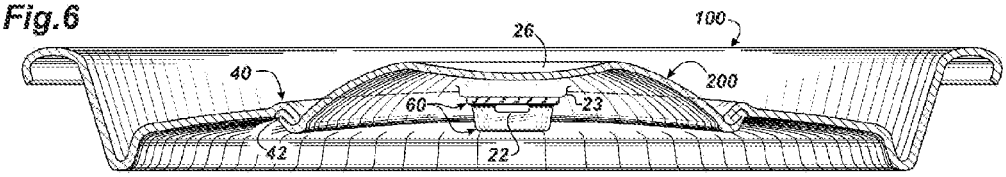

FIG. 6 is a cross-sectional left side view of the invention from a drinking view before the score line is severed.

Figure 6A:
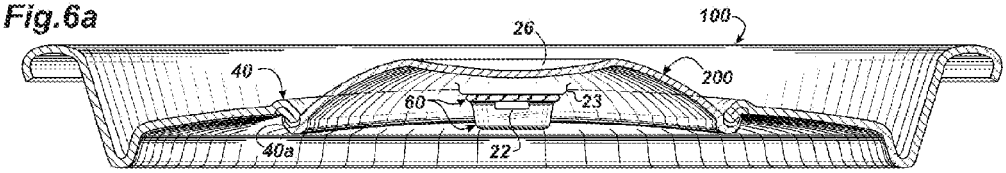

FIG. 6*a* is a cross-sectional left side view of the invention from a drinking perspective after the score line is severed and reseated to form a gas vent.

Figure 6B:
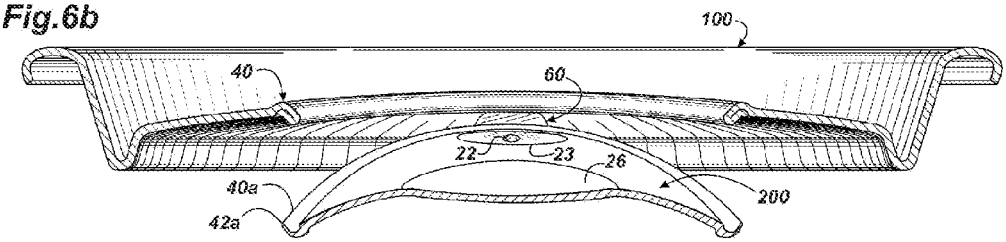

FIG. 6*b* is a cross-sectional left side view of the invention from a drinking perspective with conical drink dome in the open position.

Figure 7:
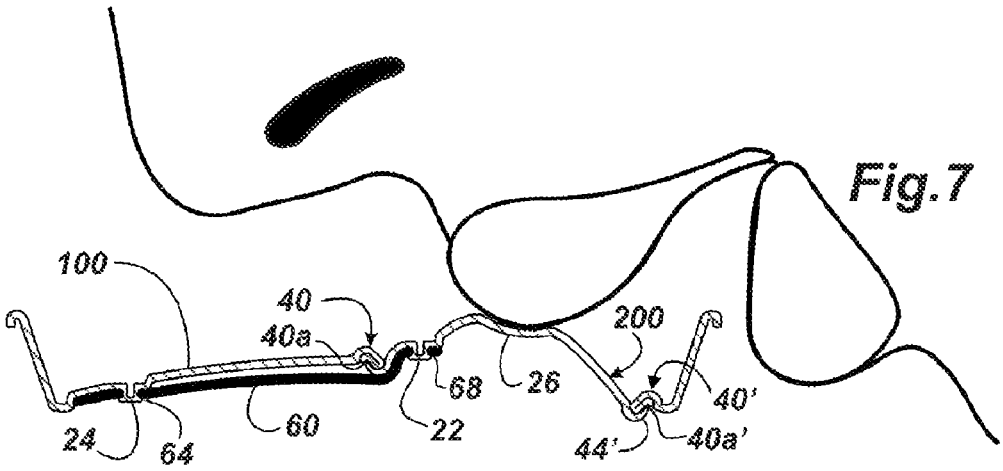

FIG. 7 is a cross-sectional left side view of the invention showing a silhouette of lips before opening the gate.

Figure 7A:
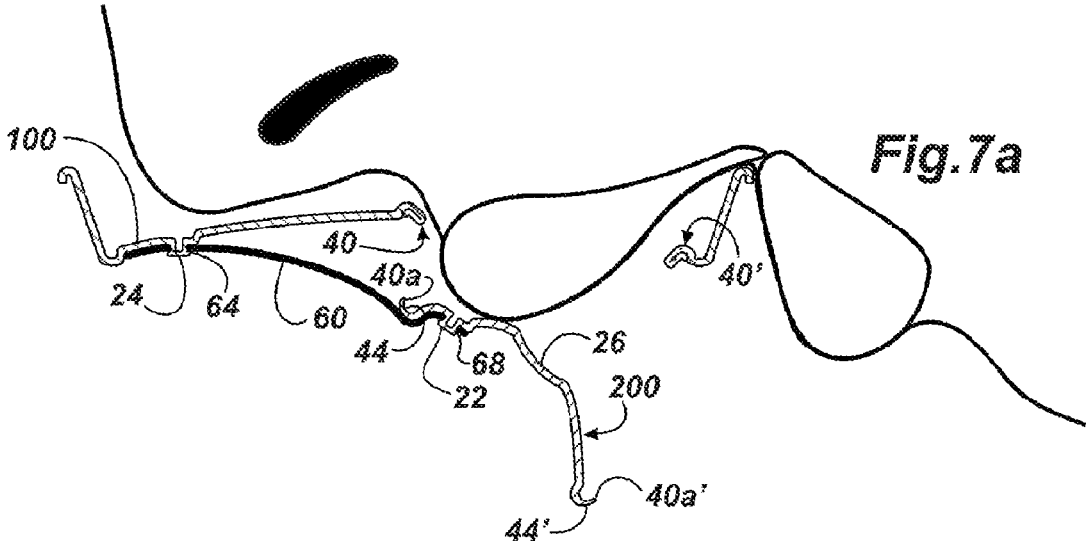

FIG. 7*a* is a cross-sectional left side view of the invention showing a silhouette of lips having opened the gate.

Figure 8:
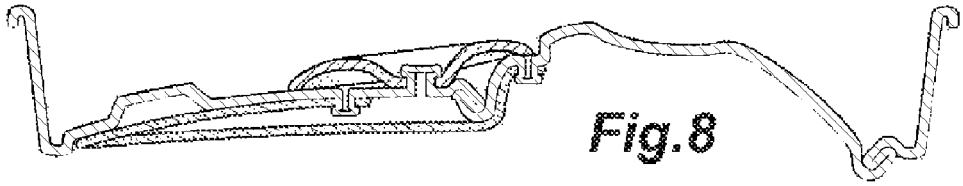

FIG. 8 is a cross-sectional left side view of optional ramped lever cam not claimed in this invention and a claimed alternative more durable spring and a claimed alternative spring fastening method.

Figure 8A:
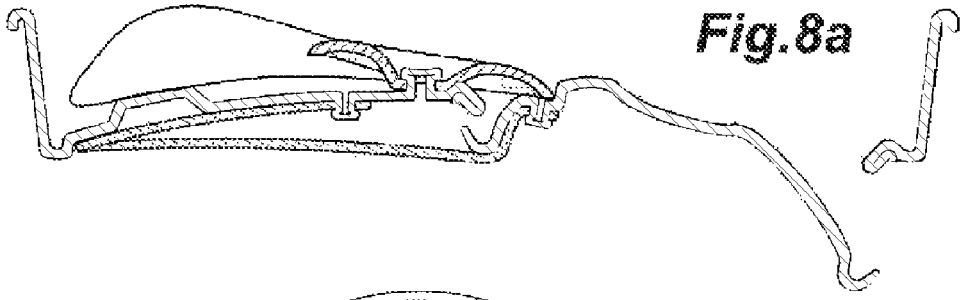

FIG. 8*a* is a cross-sectional left side view of optional ramped lever cam not claimed in this invention and a claimed alternative more durable spring and a claimed alternative spring fastening method.

Figure 8B:
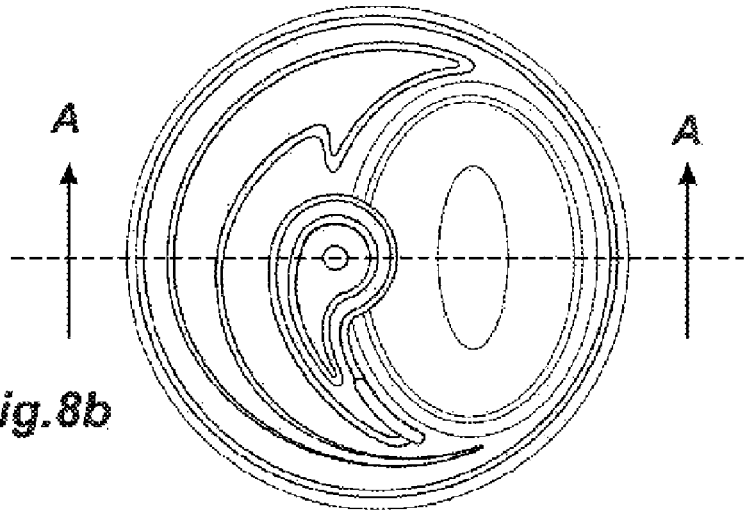

FIG. 8*b* is a plan view of an optional ramped lever cam and embossed artistic arrow ramp not claimed in this invention.

Figure 8C:
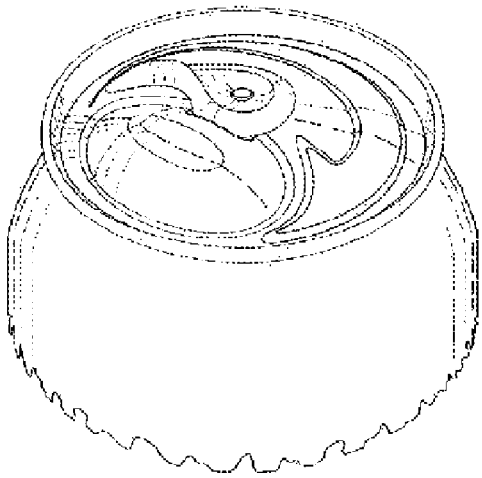

FIG. 8*c* is a perspective view of said optional ramped lever cam and embossed artistic arrow ramp not claimed in this invention.

Figure 9:
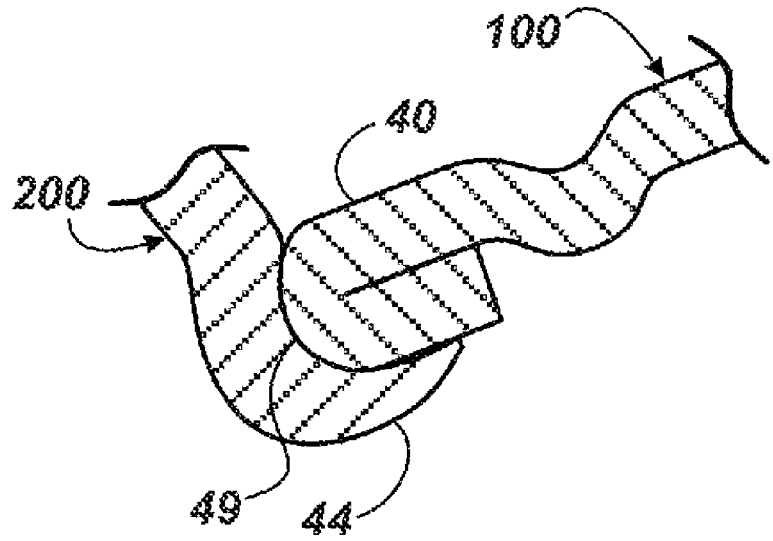

FIG. 9 is a cross-sectional left side close-up view of the distal portion of the seal.

Figure 9A:
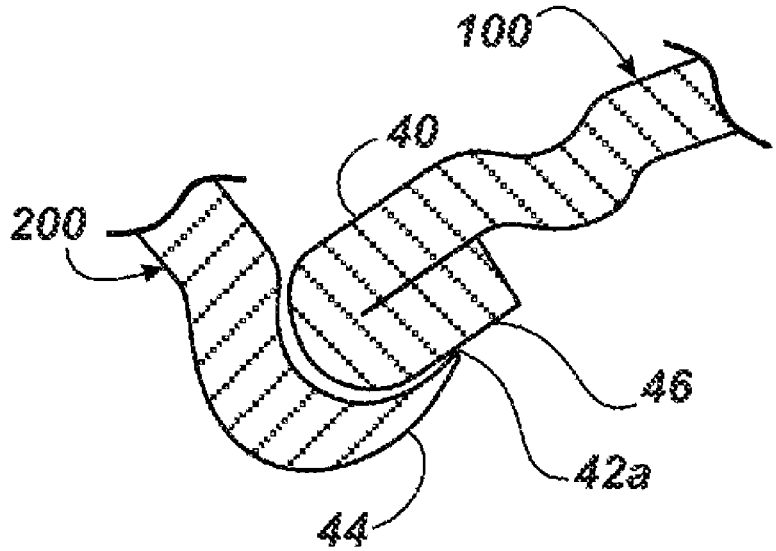

FIG. 9*a* is also a cross-sectional left side close-up view of the distal seal area.

DETAILED DESCRIPTION OF THE INVENTION

Figure 1:
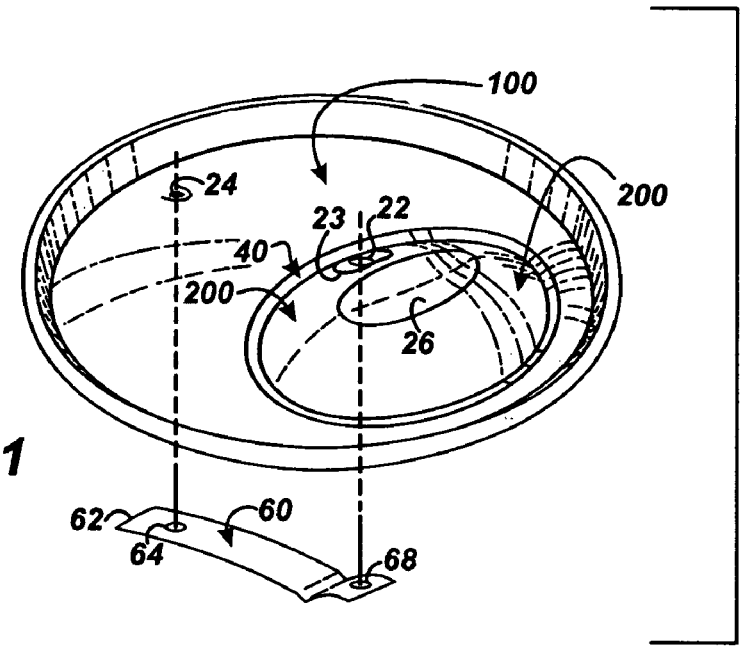
FIG. 1 is an exploded perspective view showing the improved can-end and resilient member (a spring).

Referring more particularly to the drawings, FIG. 1 illustrates a top exploded perspective view of an easy-open can-end 100 construction incorporating the principles of this invention.

FIG. 1 shows a can-end 100, conical gate 200, and resilient member 60, prior to severance of the weakened line and prior to securing of the can-end to the top end of a generally cylindrical can body, such as by conventional double seaming, for example. Such can-end 100, conical gate 200, and resilient member 60 are generally made of any combination of sheet metal such as aluminum, steel or tinplate, but all may be made of nonmetallic or laminated material.

Also shown are formed portions on both the can-end and the conical gate, called the gate stake 22 and the can-end stake 24, which serve to fasten the resilient member, through its gate stake hole 68 and its can-end stake hole 64, respectively. The interior end 23 of the resilient member is shaped and sized so that it will impinge on the underside of the can-end and prevent the conical gate from swing laterally out of alignment with the opening of the can-end.

This view also presents a lever recess 23, which is intended to locate the edge of a cam lever (not shown), a lip depression 26, which positions the upper lip of the consumer, and the can-end seam 40. This seam forms the opening of the beverage container, and is shown in greater detail in FIG. 2.

Figure 2:
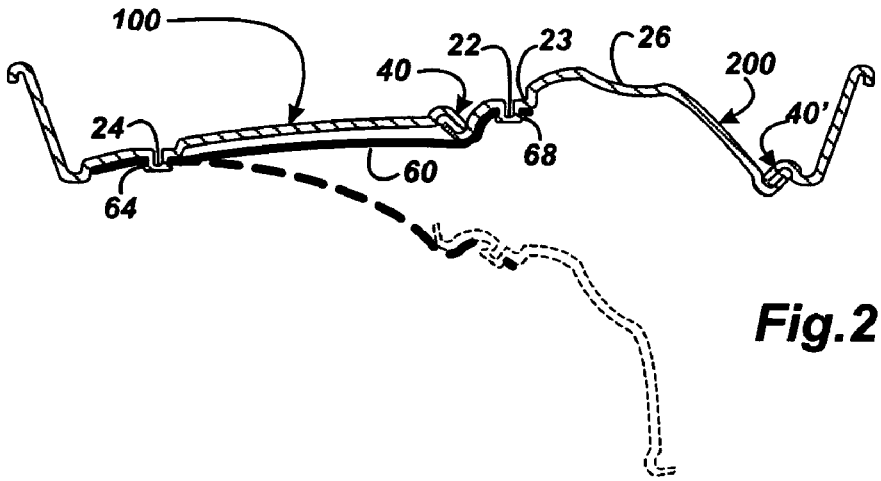
FIG. 2 is a cross sectional left side view showing both open and closed aperture.

FIG. 2 illustrates a cross section side view of can-end 100 with combined closed and opened conical gate 200 views with resilient member 60 attached. Here the proximal portion of the seam 40 is shown with the distal seam portion 40'. The gate stake 22, the can-end stake 24, the lever recess 23, the lip depression 26, the gate stake hole 68, and the can-end stake hole 64 can all be seen in cross-section.

Figure 3:
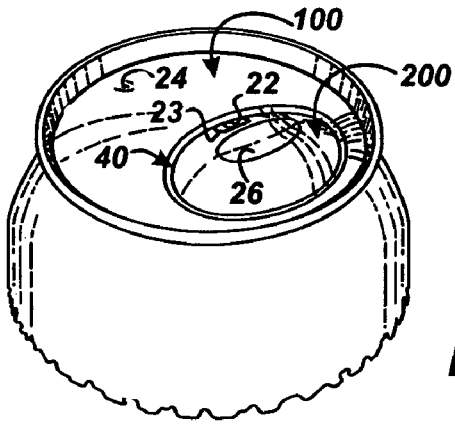
FIG. 3 is a perspective view of the invention attached to a can cylinder.

FIG. 3 is a perspective view illustrating the can-end 100 assembled to a cylindrical can body without conventional leveraged tab or leveraged ramp-cam, which may be used if preferred. Here, the gate stake 22, the can-end stake 24, the lever recess 23 and the lip depression 26 can be seen in relation to the conical gate 200, which is seated under the can-end seam 40.

FIGS. 4, 4*a*, 4*b*, 4*c* and 4*d* illustrate in isolated cross sectional exploded views the sequences of the dual-fold multi-functional integral seam 40 formed into the stamped material blank of can-end 100. These five views explain in detail the creation by severance of the 360-degree weakened line 42 the multiple functions of the multi-functional dual-fold seam 40.

When the conical gate 200 circumferentially defined weakened line 42 in FIG. 4 is severed from can-end 100 creating an independent but resiliently connected conical gate 200, the gate flange 44 is curved upwardly while severing, as shown in FIG. 4*a*. FIG. 4*b* shows the 360-degree rough severed edge 42*a* of conical gate 200 replaced against the dual-fold seam 40 smooth surface area 46 from which it was severed, in the self-closed vented position, and the dashed line arrow indicating carbonated gas flow 48 venting between the rough severed edge 42*a* and smooth surface area 46 which it is replaced against. FIG. 4*c* shows excessive gas flow forcing the conical gate 200 upwardly 45 against the dual-fold seam 40 causing the gate flange 44 to bend and compress around its perimeter, reducing the clearance between the dual-fold seam 40 and the conical gate 200, while also reducing the angle of the gate flange 44 relative to the smooth surface 46 of the dual-fold seam 40, further reducing the gas flow of the venting function, which enhances the speed at which the self-sealing function is completed. FIG. 4*d* illustrates the conical gate 200 as it is forced further upwards 45, and dual-fold seam 40 rotating inwardly into contact with mating circumferential seal surface of the conical gate 200 to form the gas-tight seal 49.

FIGS. 5, 5*a*, and 5*b* illustrate a cross sectional side view of the can-end before the weakened line is severed, the weakened line is severed and the conical gate is returned, and the conical gate in the open position, respectively. Note that the newly exposed surface of gate flange now becomes gate mating surface 40*a*. [In these views, when item numbers have a prime notation (′), it means that portion is the more distal of the two locations shown in the figure, for that single item]

FIGS. 6, 6*a*, and 6*b* illustrate a cross section front view of the can-end before the weakened line is severed, the weakened line is severed and the conical gate is returned, and the conical gate in the open position, respectively.

FIGS. 7 and 7*a* illustrate a cross section side view of the can-end, after severing the weakened line, and being user-lip operated in closed, then opened position, respectively.

FIGS. 8, 8*a*, 8*b*, and 8*c* show an alternative to the preferred embodiment push-down conical gate using a digitally operated rotational lever-cam and cam follower integral to the conical gate that facilitates pushing downwardly to first break the weakened line and then pushes outwardly and downwardly on the conical gate cam follower to complete the severing of the weakened line. The raised half-arrow around the circumferential perimeter of the can-end serves to reinforce and raise the digitally operated end of the lever-cam to enhance initial severing of the weakened score line and to illustrate to first time users the proper rotational direction of the lever-cam.

FIGS. 9 and 9*a* illustrate the can-end 100 and conical gate 200 contacting each other in an alternate embodiment of the invention. Here the can-end assembly is a multiple piece construction, where the gate 200 is a separate piece of material prior to assembly. In this case, the mating surfaces of the gate and the can-end are temporarily bonded together with an appropriate food-grade adhesive substance (not shown), such as corn syrup, or some other suitably-engineered chemical agent. In this alternate embodiment, the separate gate 200 operates the same way still, and reacts to gas pressure in a similar fashion.

The invention claimed is:

1. A self-closing resealable can end for a beverage container comprising:

a top panel with an integrated gate contained as part of a folded seam with a weakened line that forms a closed perimeter surrounding the integrated gate;

the integrated gate adapted to separate along the weakened line with the application of downward pressure to form:

A) an opening along the entirety of the closed perimeter and;

B) a separated gate distinct from the top panel;

the integrated gate connected to a first portion of a resilient member with another portion of the resilient member connected to the top panel beyond the closed perimeter such that a separated gate is indirectly connected to the top panel through the resilient member; and the resilient member adapted to:

C) yield to downward pressure to allow the separated gate to move away from the top panel; and D) after the cessation of downward pressure, place the separated gate in sufficient proximity to the opening formed in the top panel such that gas pressure formed above a surface of a carbonated beverage placed within a beverage container using the self-closing resealable can end will press the separated gate into contact with the top panel with sufficient force to bend the separated gate for an enhanced seal.

2. The self-closing resealable can end of a beverage container of claim 1 wherein the self-closing resealable can end is connected to a generally cylindrical can body.

3. The self-closing resealable can end of a beverage container of claim 1 wherein a portion of the integrated gate extends above the top panel such that a user may press a portion of a lip against the separated gate to push the separated gate downward and create a fluid path through the opening.

4. The self-closing resealable can end of a beverage container of claim 3 wherein the integrated gate has a lip depression to assist in positioning the lip of a user.

5. The self-closing resealable can end of a beverage container of claim 1 wherein the weakened line is isolated from a top surface of the self-closing resealable can end so there are no exposed sharp can opening edges.

6. The self-closing resealable can end of a beverage container of claim 1 wherein a perimeter of the separated gate is curved and corresponds to curved portion of the top panel.

7. The self-closing resealable can end of a beverage container of claim 6 wherein a perimeter of the separated gate is concave and receives a convex lip of the top panel.

8. The self-closing resealable can end of a beverage container of claim 1 wherein the integrated gate is contained as part of a dual-fold seam formed into a stamped blank for a can end used in a process to make the top panel.

9. A self-closing resealable can end for a beverage container comprising:

a top panel with an integrated gate surrounded by a weakened line that forms a closed perimeter surrounding the integrated gate;

the integrated gate adapted to separate along the weakened line with the application of downward pressure to form:

A) an opening along the entirety of the closed perimeter wherein the separated weakened line on the top panel is isolated from a top surface of the self-closing resealable can end so there are no exposed sharp can opening edges; and;

B) a separated gate distinct from the top panel;

the integrated gate connected to a first portion of a resilient member with another portion of the resilient member connected to the top panel beyond the closed perimeter such that the separated gate is indirectly connected to the top panel through the resilient member; and the resilient member adapted to:

C) yield to downward pressure to allow a separated gate to move away from the top panel; and D) after the cessation of downward pressure, place the separated gate in sufficient proximity to the opening formed in the top panel such that gas pressure formed above a surface of a carbonated beverage placed within a beverage container using the self-closing resealable can end will press the separated gate into contact with the top panel with sufficient force to bend the separated gate for an enhanced seal.

* * * * *